US005667322A

United States Patent [19]

Mucznik

[11] Patent Number: 5,667,322

[45] Date of Patent: Sep. 16, 1997

[54] BINDER AND FOLDER COMBINATION

[75] Inventor: Cheryl Mucznik, Tel Aviv, Israel

[73] Assignee: Press Engineering (Proprietary) Limited, Johannesburg, South Africa

[21] Appl. No.: 520,759

[22] Filed: Aug. 29, 1995

[30] Foreign Application Priority Data

Aug. 30, 1994 [AU] Australia ..... PM7769

[51] Int. Cl.[6] ..... B42F 13/06; B42F 13/08

[52] U.S. Cl. ..... 402/8; 402/14; 402/18; 402/75

[58] Field of Search ..... 402/8, 14, 15, 402/18.24, 19.25, 79, 80 L, 75; 281/29, 38

[56] References Cited

U.S. PATENT DOCUMENTS

| | | | |
|---|---|---|---|
| 4,130,933 | 12/1978 | Demerick | 29/33.5 |
| 4,236,731 | 12/1980 | Hektoen . | |
| 4,256,411 | 3/1981 | Podosek | 402/73 |
| 4,285,104 | 8/1981 | Corey et al. . | |
| 4,453,851 | 6/1984 | Purcocks | 402/15 |
| 4,560,299 | 12/1985 | Podosek | 402/15 |
| 4,856,926 | 8/1989 | Hirsch | 402/13 |
| 4,950,097 | 8/1990 | Blumberg | 402/14 X |
| 4,993,861 | 2/1991 | Blumberg et al. | 402/14 X |
| 5,007,758 | 4/1991 | Blumberg | 402/75 |
| 5,011,318 | 4/1991 | Gilmore | 402/14 |
| 5,364,199 | 11/1994 | Hillmer-Mann | 402/68 |
| 5,524,929 | 6/1996 | Emmel et al. | 281/21.1 |

*Primary Examiner*—Frances Han

*Attorney, Agent, or Firm*—Wood, Herron & Evans, L.L.P.

[57] ABSTRACT

A folder for use with a metal binder having an elongate body portion and a prong extending from each end thereof includes a front cover sheet. A rear cover sheet is pivotally connected to the front cover sheet and has a pair of spaced openings defined therein. An adhesive layer is arranged on an operatively outer side of the rear cover sheet, between the openings.

6 Claims, 2 Drawing Sheets

BINDER AND FOLDER COMBINATION

FIELD OF THE INVENTION

THIS INVENTION relates to a folder and to a folder and binder combination for attaching papers or the like within the folder.

BACKGROUND OF THE INVENTION

It has long been the practice to attach loose papers to a backing member or to the interior of a file folder by means of a sheet metal fastener or binder having a central portion from the opposite ends of which extend a pair of paper impaling prongs. These prongs are extendable generally vertically from the backing member for purposes of placement of holes in the paper over the prongs after which the prongs are bent downwardly against or toward the backing member.

Quite commonly, the fastener device or binder has the central portion attached to the backing member or folder so that it becomes a permanent part of the folder. Several different techniques for attachment of the binder to the folder have been developed, but all of these attachment techniques have imparted substantial cost and weakened folders to the folder binder combination.

One of the current commercial techniques for securement of the central portion of the binder to the backing member is by forming ears or tabs on the central portion of the binder, which ears or tabs are, during assembly of the folder and binder, forced through the body of the folder and bent outwardly under the central portion of the file folder so as to lock the binder to the folder. But the formation of these ears on the sheet metal fastener body substantially increases the width of the strip from which the fastener is stamped during manufacture, with the result that the presence of the ears on the tabs increases the total quantity of metal employed in the fastener by as much as 25–50%, depending upon the length of the ears or tabs. Furthermore, in order to assemble this type of binder to a backing member, it is necessary to punch a series of spaced slots in the locking member for acceptance of the tabs or ears of the binder. These spaced slots naturally weaken the backing member about the area of the binder such that with heavy duty filing and frequent usage, the binder may be torn loose from the folder.

Another technique for securing the central portion of a sheet metal binder to a backing member or folder is to attach to the central portion of the base member an adhesive plate made from reinforced paperboard or similar material having some form of adhesive, such as hot melt glue, on one surface. This plate has holes adjacent its opposite ends through which the prongs of the fastener extend as illustrated, for example, in U.S. Pat. No. 4,285,104. The central portion of the sheet metal binder is attached to this backing plate by the adhesive, and the complete backing plate is subsequently adhered to the surface of the backing member or folder. This type of attachment of the fastener to the folder though is relatively expensive, involving not only expensive machinery for manufacturing and assembling the fastener and the attachment plate, but also relatively expensive machinery for assembling the fastener to the backing member or folder. Furthermore, this type of binder is of necessity attached to the inside surface of the folder. The attachment of the binder to the folder therefore relies solely for its strength upon the adhesive bond of this plate to the inside surface of the folder. In use, this type of binder is subject to being pulled away from the inside surface of the folder with the result that the binder may relatively easily be pulled free from the folder, either because of adhesive failure or pulling away of the surface skin of the folder from the folder body.

Yet another current commercial practice for attachment of the central portion of a sheet metal binder to a backing member has been to apply release or pressure sensitive adhesive to one surface of the central portion of the binder and overlay that pressure sensitive adhesive with a release liner paper or similar material. This binder is attached to the folder by removal of the liner material to expose the pressure sensitive adhesive after which the prongs of the binder are inserted through holes in the backing member or folder such that the pressure sensitive adhesive comes into contact with the surface of the backing member or folder and adheres the binder to it. This type of binder generally has rounded corners on the central portion of the binder so as to minimize the binders of adjacent folders catching and hanging up on one another or on the edges of adjacent folders when the backing members or folders are filed.

It has been an objective of this invention to provide an improved binder and folder combination which minimizes not only cost but also which minimizes filing problems encountered as a result of exposed binders catching and hanging up on the edges of adjacent binders or folders.

Yet another objective of this invention has been to provide a stronger and longer lasting binder and folder combination by:

(a) eliminating the need for binder tabs or ears and spaced slots in the backing member or folder to accommodate those tabs or ears. The elimination of those slots in the backing member or folder eliminates a weak point in the folder and reduces the possibility of the binder being torn from the backing member or folder; and (b) adhesively attaching the binder to the outside surface of the folder (as opposed to the inside surface). The user of the folder, therefore, when pulling the binder open, pulls the binder toward rather than away from the adhesive because the adhesive is sandwiched between the binder and the outside surface of the folder or backing member. In that way, the binder and folder combination relies upon the strength of the entire thickness of folder material for its strength, rather than the strength of the adhesive bond alone.

SUMMARY OF THE INVENTION

According to a first aspect of the invention, there is provided a folder for use with a metal binder having an elongate body portion and a prong extending from each end thereof, which includes:

a front cover sheet;

a rear cover sheet pivotally connected to the front cover sheet and having a pair of spaced openings defined therein; and an adhesive layer on an operatively outer side of the rear cover sheet, between the openings.

In this specification, the word "pivotally" is to be understood also to mean "foldably" when used in relation to the rear cover sheet.

The adhesive may have a cover strip arranged thereon which, in use, is removed by a user prior to the central body portion being adhered to the rear cover sheet via the adhesive layer.

The adhesive layer may thus be applied by a manufacturer and the binder engaged therewith by a user (as indicated above) immediately prior to use. Or alternatively, the adhesive may be applied, in liquid form, by the manufacturer of the folder and the binder engaged therewith immediately during manufacture.

The front cover sheet and the rear cover sheet may be defined by a single sheet of flexible material having a folded region to define a spine of the folder. The folder may include a strengthening means for strengthening the spine of the folder. The strengthening means may be in the form of a strip of flexible reinforcing material which is adhered to the spine. The reinforcing material may also be decorative.

Further, the reinforcing material is preferably of sufficient width to cover the central body portion of the binder once the central body portion has been attached to the cover sheet. The reinforcing material may be in the form of a plastics material.

According to a second aspect of the invention there is provided a folder for use with a metal binder having an elongate body portion and a prong extending from each end thereof, which includes:

a front cover sheet;

a rear cover sheet pivotally connected to the front cover sheet and having a depression on an operatively outer side thereof in which the body portion of the binder is received and a pair of spaced openings through which the prongs may pass.

The depression may be elongate. The openings may be located at the ends of the depression. It will be appreciated that the depression may extend beyond the openings.

The folder may have an adhesive layer in the depression. The adhesive layer may be covered by a removable strip.

The depression may be embossed.

The invention extends to the folder in combination with the binder, with the body portion of the binder residing in the depression and the prongs passing through the openings.

The invention is now described, by way of example, with reference to the accompanying drawings.

DETAILED DESCRIPTION OF DRAWINGS

Figure 1:
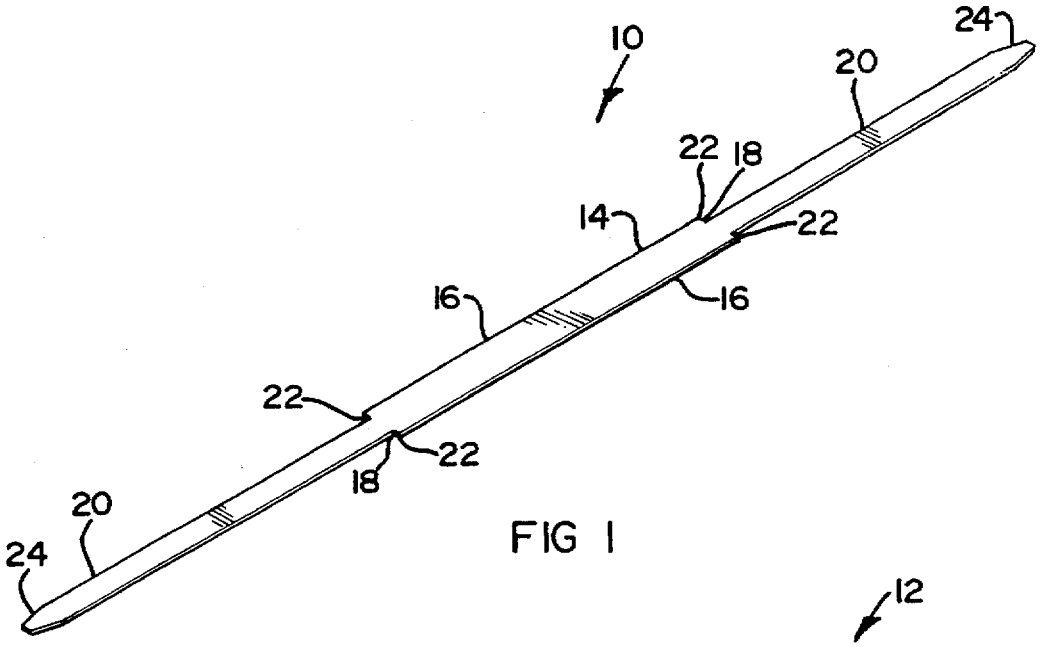
FIG. 1 shows a perspective view of a binder for use with a folder in accordance with a second aspect of the invention.

In the drawings, reference numeral 10 generally indicates a binder for use with a folder in accordance with a second aspect of the invention, while reference numeral 12 generally indicates the folder of the second aspect of the invention.

The binder 10 includes an elongate rectangular central body portion 14. The body portion 14 has a pair of opposed long sides 16 and a pair of opposed short sides 18. A prong 20 extends from each short side 18 of the body portion 14, the prongs 20 being narrower than the body portion 14.

It will be appreciated that the binder 10 has a right angled shoulder 22 at the junction between each prong 20 and the body portion 14 on each side of the body portion 14.

The binder 10 is of metal. Hence, the binder 10 is cut from a metal sheet. It is to be appreciated that, as a result of the shape of the binder 10, cutting of the binder 10 from the metal sheet is facilitated. Furthermore, wastage of material is reduced as a result of the shape of the binder 10, during manufacture of the binder 10. Free ends 24 of each prong 20 are pointed to facilitate use of the binder 10.

The folder 12 includes a rear cover sheet 26 and a front cover sheet 28. The rear cover sheet 26 and the front cover sheet 28 are defined by a single sheet 30 of a flexible material having a folded region 32 to define a spine 34 of the folder 12.

The rear cover sheet 26 has two spaced openings 36 defined therein. A depression 38 is defined in an operatively outer side 40 of the rear cover sheet 26, between the openings 36. The body portion 14 of the binder 10 is receivable in the depression 38 with the prongs 20 of the binder 10 passing through the openings 36.

The rear cover sheet 26 is embossed to define the depression 38.

Figure 3:
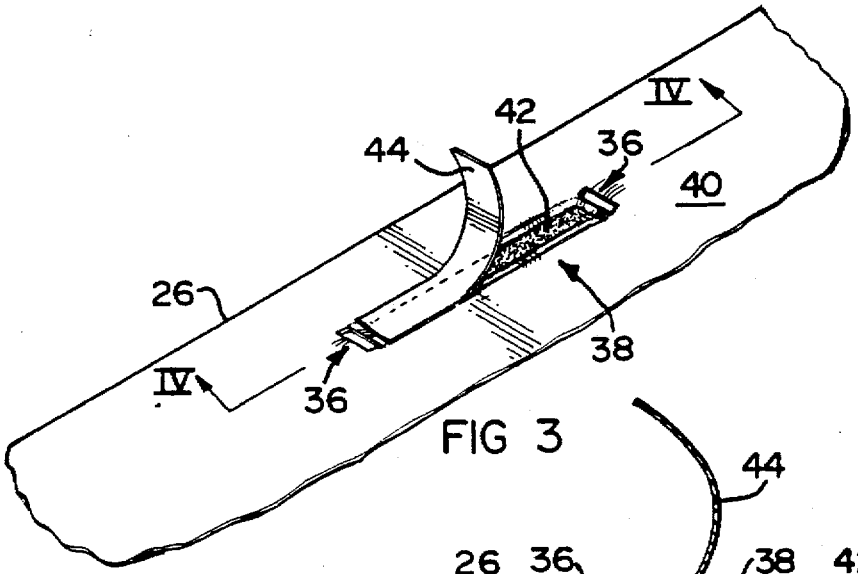
FIG. 3 shows a three-dimensional view of a first stage in the attachment of the binder to the folder.
Figure 4:
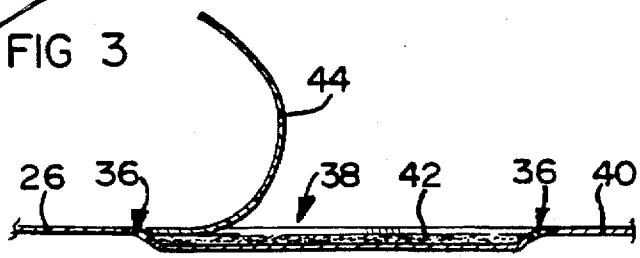
FIG. 4 shows a sectioned side view of the first stage.
Figure 5:
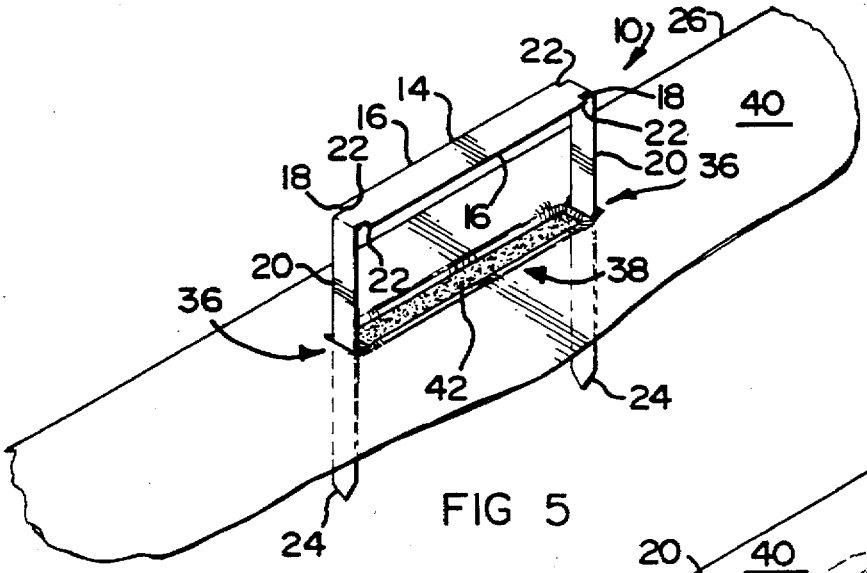
FIG. 5 shows a second stage in the attachment of the binder to the folder.
Figure 6:
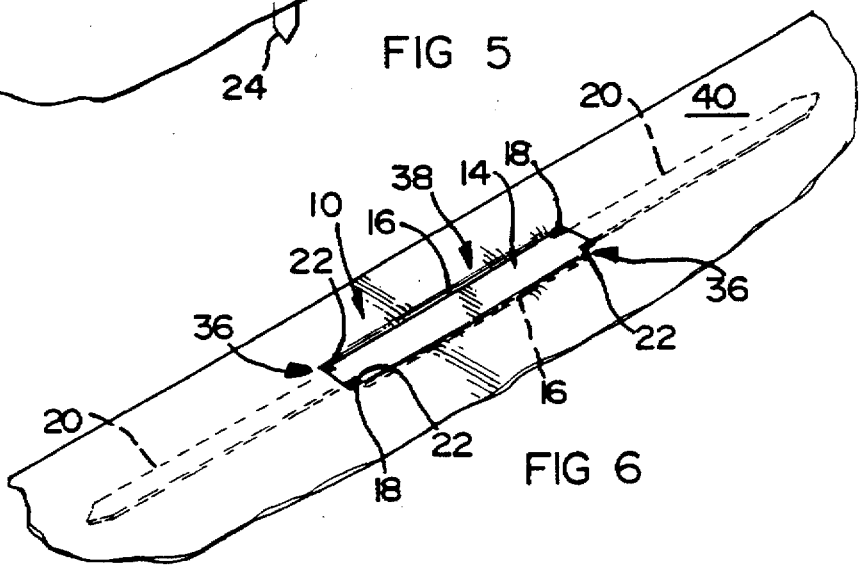
FIG. 6 shows a third and final stage in the attachment of the binder to the folder.

An adhesive layer 42 (FIGS. 3, 4 and 5) is arranged on the outer side 40 of the rear cover sheet 26 within the depression 38. This adhesive may be applied in liquid form during manufacture and assembly of the folder. If the binder is to be assembled with the cover sheet 26 by a user subsequent to manufacture, then a cover strip 44 (FIG. 3) is applied over the adhesive. Alternatively, if the binder is attached to the cover sheet during manufacture of the folder, then the cover strip is omitted. If a cover strip 44 is applied over the adhesive layer 42, the cover strip 44 is preferably made of a plastics material, which, in use, is removed by a user prior to the central body portion 14 being adhered to the rear cover sheet 26 via the adhesive layer 42.

The process of attaching the binder 10 to the folder 12 includes essentially three steps, the steps being shown in FIGS. 3 to 6. If there is a cover strip 44, step one (FIG. 3) is carried out by removing the cover strip 44 from the adhesive layer 42.

Step two (FIG. 5) is carried out by bending the prongs 20 relative to the body portion 14 so that the prongs 20 can be inserted through the spaced openings 36.

Step three (FIG. 6) is carried out by adhering the central body portion 14 to the adhesive layer 42 and bending the prongs back into their original position.

Figure 2:
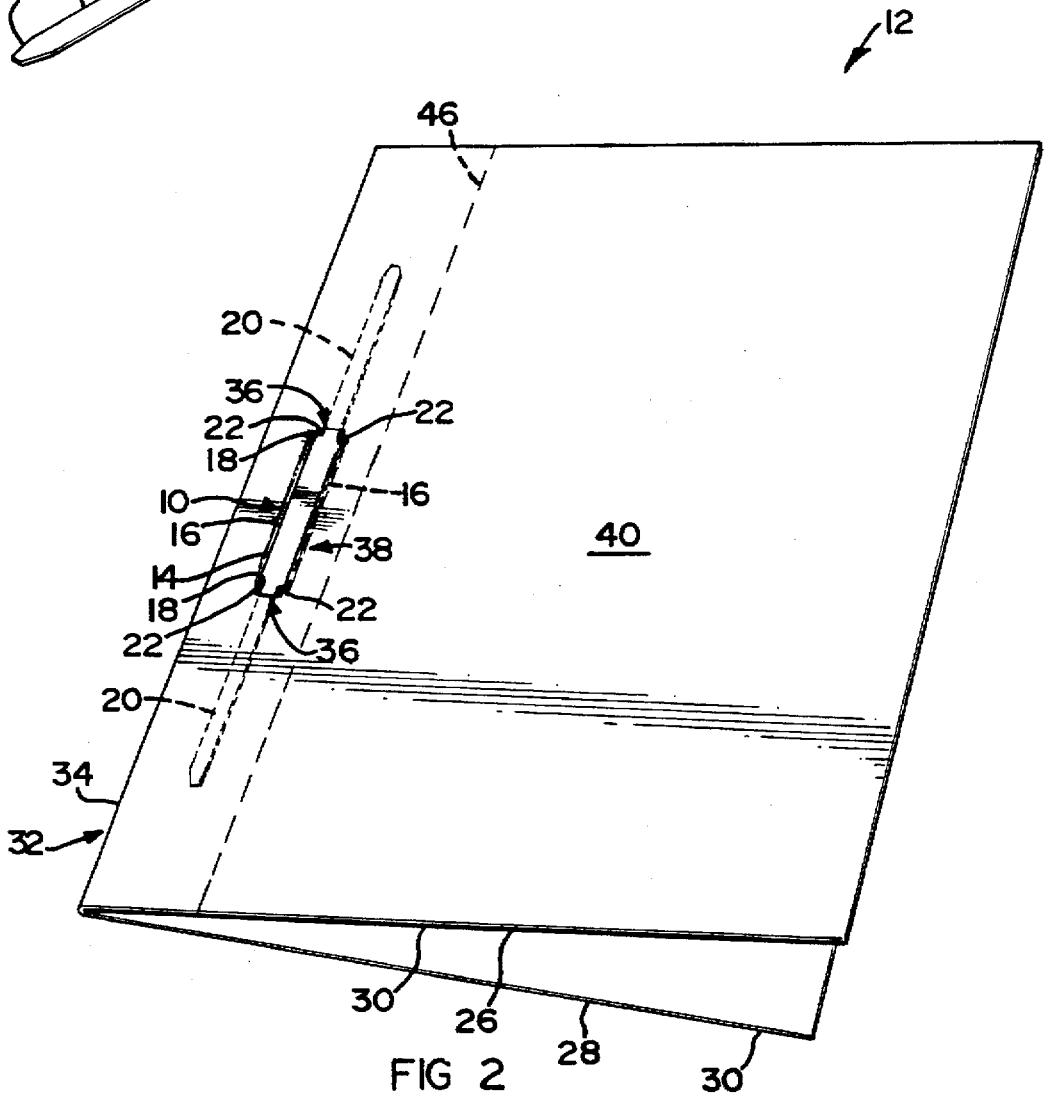
FIG. 2 shows a perspective rear view of the folder.

The folder 12 preferably includes a strengthening means in the form of a strip 46 of flexible reinforcing plastics material (indicated by the dotted lines in FIG. 2) which is adhered to the exterior surface of the spine 34. The strip 46 is, as can be seen in FIG. 2, of a sufficient width to cover the central body portion 14 of the binder 10 once it has been adhered to the adhesive layer 42. Hence, the strip 46 is also decorative.

The invention of this application provides a folder and a binder combination which is relatively simple and cost effective to manufacture.

While I have described only a single preferred embodiment of my invention, persons skilled in this art will appreciate changes and modifications which may be made without departing from the spirit of my invention. I therefore intend it to be claimed only by the scope of the following appended claims.

I claim:

1. A folder for use with a metal binder having an elongate body portion and a prong extending from each end thereof, the folder comprising:

a front cover sheet;

a rear cover sheet having an inner side and an outer side, the rear cover sheet being pivotally connected to the front cover sheet and having a pair of spaced openings defined therein;

an adhesive layer on the outer side of the rear cover sheet and extending between the openings; and a removable cover strip located on the adhesive layer to cover the adhesive layer;

wherein, when the removable cover strip is removed from the adhesive layer and each prong of the metal binder is inserted from the outer side of the rear cover sheet through one of the openings, the adhesive layer adheres the elongate body portion of the metal binder onto the outer side of the rear cover sheet between the spaced openings.

2. The folder as claimed in claim 1 further comprising:

an elongate depression having spaced ends and being on the outer side of the rear cover sheet, the adhesive layer being located in the depression, each of the openings being located at one of the ends of the depression.

3. The folder of claim 2 in which the depression has been embossed.

4. A folder and metal binder combination comprising:

a metal binder having an elongate body portion and a prong extending from each end thereof;

a folder including a front cover sheet and a rear cover sheet pivotally connected to the front cover sheet, the rear cover sheet having an inner side and an outer side;

a pair of spaced openings in the rear cover sheet; and an adhesive layer extending between the openings and being sandwiched between the outer side of the rear cover sheet and the body portion of the binder to adhere the binder to the rear cover sheet with each of the prongs passing through one of the openings.

5. The combination of claim 4 further comprising:

an elongate depression having spaced ends and being on the outer side of the rear cover sheet, the adhesive layer being located in the depression and each of the openings being located at one of the ends of the depression.

6. The combination of claim 5 in which the depression has been embossed.

* * * * *